US011324270B2

(12) United States Patent
Tunison

(10) Patent No.: US 11,324,270 B2
(45) Date of Patent: May 10, 2022

(54) HATS WITH AN OPEN BACK AND METHODS OF MAKING THE HATS

(71) Applicant: Stacie Tunison, Lander, WY (US)

(72) Inventor: Stacie Tunison, Lander, WY (US)

( * ) Notice: Subject to any disclaimer, the term of this patent is extended or adjusted under 35 U.S.C. 154(b) by 558 days.

(21) Appl. No.: 15/974,139

(22) Filed: May 8, 2018

(65) Prior Publication Data

US 2018/0325200 A1 Nov. 15, 2018

Related U.S. Application Data

(60) Provisional application No. 62/503,626, filed on May 9, 2017.

(51) Int. Cl.

| | |
|---|---|
| ***A41B 1/22*** | (2006.01) |
| ***A42B 1/22*** | (2006.01) |
| ***A42B 1/004*** | (2021.01) |
| ***A42C 1/00*** | (2006.01) |

(52) U.S. Cl.

CPC ..... *A42B 1/225* (2013.01); *A42B 1/004* (2013.01); *A42C 1/00* (2013.01)

(58) Field of Classification Search

CPC ..... A41B 1/225; A41B 1/004; A42C 1/00
See application file for complete search history.

(56) References Cited

U.S. PATENT DOCUMENTS 1,862,161 A * 6/1932 Reynolds ..... A42C 5/02 223/22
4,481,681 A * 11/1984 Hankin ..... A41D 20/00 2/181
4,815,148 A * 3/1989 Satterfield ..... A42B 1/22 2/195.1
5,471,683 A * 12/1995 Moretz ..... A42C 5/02 2/169
5,584,076 A * 12/1996 Armstrong ..... A42B 1/22 2/181.4
6,199,213 B1 * 3/2001 Whang ..... A42B 1/06 2/181
6,240,566 B1 * 6/2001 Scantlin ..... A42B 1/225 2/171
7,024,702 B2 * 4/2006 Kronenberger ..... A42B 1/06 2/209.3
7,082,620 B1 * 8/2006 Rongione ..... A42B 7/00 2/175.1
7,278,173 B2 * 10/2007 Turner ..... A42B 1/0182 2/209.4
7,962,971 B1 * 6/2011 Spence ..... A42B 1/206 2/209.11
8,573,773 B1 * 11/2013 Acosta ..... G02C 3/02 351/155
10,098,400 B2 * 10/2018 Johnson ..... A42B 1/206
10,463,101 B2 * 11/2019 Clark ..... A42C 5/04
D919,242 S * 5/2021 Macllwaine ..... D2/876
(Continued)

*Primary Examiner* — Richale L Quinn

(74) *Attorney, Agent, or Firm* — Coats & Bennett, PLLC

(57) ABSTRACT

Hats and methods of making the hats. The hats include a closed front and an open back. A band extends around the back to attach the hat to the user. The band is constructed to securely attach the hat to the user, and also have an attractive appearance. Further, the band is adjustable to accommodate a variety of different users. The band includes a variety of materials that are secured in an overlapping arrangement with extensions.

9 Claims, 5 Drawing Sheets

(56) References Cited

U.S. PATENT DOCUMENTS

| | | | | |
|---|---|---|---|---|
| 2003/0097705 | A1* | 5/2003 | Han | A42C 5/02 2/171 |
| 2006/0048275 | A1* | 3/2006 | Cho | A42C 5/02 2/195.1 |
| 2008/0034473 | A1* | 2/2008 | Wong | A42C 5/02 2/181 |
| 2013/0042388 | A1* | 2/2013 | Lasko | A42B 1/24 2/209.13 |
| 2018/0325200 | A1* | 11/2018 | Tunison | A42C 1/00 |

* cited by examiner

HATS WITH AN OPEN BACK AND METHODS OF MAKING THE HATS

CROSS-REFERENCE TO RELATED APPLICATIONS

The present application claims the benefit of U.S. Application No. 62/503,626 filed on May 9, 2017. This application is hereby incorporated by reference in its entirety.

BACKGROUND

Hats are worn by users for a variety of different reasons. Hats provide protection for the user such as to block the sun, shield the user's head and/or face from environmental elements such as rain, sleet, and snow, and provide warmth. Hats are also worn as fashion pieces to provide the user with a particle look or style.

Some hats may be uncomfortable for the user. This may be caused by the hat being too warm for the user. This may also be caused by the user having long hair that is being worn up (e.g., in a bun or pony-tail) and not able to fit under a hat. Users in these situations may not want to wear a hat because of these issues.

Further, hats have been in existence for many years. User's may like the functionality of a hat, such as a front bill that shields their face from the sun, but also would like a different look for their hat.

Thus, there is a need for a new type of hat and methods of making the hat that includes various features that facilitate its use.

SUMMARY

One aspect is directed to a method of making an open-back hat that includes a front section with first and second lateral sides. The method includes overlapping a first end of a first extension with a first band at the first lateral side and positioning a second end of the first extension outward and away from the first lateral side. The method includes folding a bottom of the first band over the first end of the first extension. The method includes folding a top of the first band over the first end of the first extension. The method includes attaching together the folded bottom, the folded top, and the first end of the first extension. The method includes overlapping a first end of a second extension with a second band at the second lateral side and positioning a second end of the second extension outward and away from the second lateral side. The method includes folding a bottom of the second band over the first end of the second extension. The method includes folding a top of the second band over the first end of the second extension. The method includes attaching together the folded bottom, the folded top, and the first end of the second extension.

In one aspect, the method also includes overlapping the first end of the first extension on a sweat band at the first band and overlapping the first end of the second extension on the sweat band at the second band.

In one aspect, folding the bottom of the first band over the first end of the first extension includes folding an end of the first band over the first end of the first extension.

In one aspect, folding the bottom of the second band over the first end of the second extension includes folding an end of the second band over the first end of the second extension.

In one aspect, the bottom of the first and second bands is constructed from cotton and the top of the first and second bands is constructed from mesh.

In one aspect, the method also includes forming an opening at a back of the hat between the first and second extensions and the first and second lateral sides.

In one aspect, the method also includes narrowing a width of the first band at the first extension and narrowing a width of the second band at the second extension.

In one aspect, the method also includes positioning an inner layer along a section of the first extension.

In one aspect, the method also includes positioning openings that extend through the first extension outward beyond the first band and positioning protrusions on the second extension outward beyond the second band.

One aspect is directed to a method of making an open-back hat that includes a front section with first and second lateral sides. The method includes overlapping a first end of a first extension at the first lateral side. The method includes folding a bottom of the first lateral side over the first end of the first extension. The method includes folding a top of the first lateral side over the first end of the first extension. The method includes attaching together the first lateral side to the first extension. The method includes overlapping a first end of a second extension at the second lateral side. The method includes folding a bottom of the second lateral side over the first end of the second extension. The method includes folding a top of the second lateral side over the first end of the second extension, and attaching together the second lateral side to the second extension.

In one aspect, the method also includes narrowing a width of the first lateral side to the first extension and the second lateral side to the second extension.

One aspect is directed to a method of making an open-back hat that includes a front section with first and second lateral sides. The method includes overlapping a first end of a first extension over a first band at the first lateral side and overlapping a first end of a second extension over a second band at the second lateral side. The method includes positioning second ends of the extensions outward and away from the first and second lateral sides. The method includes folding a first section of the first band over the first end of the first extension and attaching the folded first section to the first extension. The method includes folding a second section of the first band over the folded first section and attaching the folded second section to the folded first section. The method includes folding a first section of the second band over the first end of the second extension and attaching the folded first section to the second extension. The method includes folding a second section of the second band over the folded first section and attaching the folded second section to the folded first section.

In one aspect, the first sections of the first and second bands are constructed from cotton and the second sections of the first and second bands are constructed from mesh.

In one aspect, the method also includes forming an opening at a back of the hat between the first and second extensions and the front section.

In one aspect, the method also includes folding a first end of the first band back over an inner portion of the first band and securing the folded first end prior to folding the first section of the first band over the first end of the first extension and attaching the folded first section to the first extension.

In one aspect, the method also includes narrowing a width of the first band at the first extension and at the second band at the second extension.

In one aspect, the method also includes attaching the first extension to the first band prior to attaching the second extension to the second band.

In one aspect, the method also includes simultaneously attaching the first and second extensions to the front section.

The various aspects of the various embodiments may be used alone or in any combination, as is desired.

DETAILED DESCRIPTION

The present application is directed to hats that include a closed front and an open back. A band extends around the back to attach the hat to the user. The band is constructed to securely attach the hat to the user, and also have an attractive appearance. Further, the band is adjustable to accommodate a variety of different users.

Figure 1:
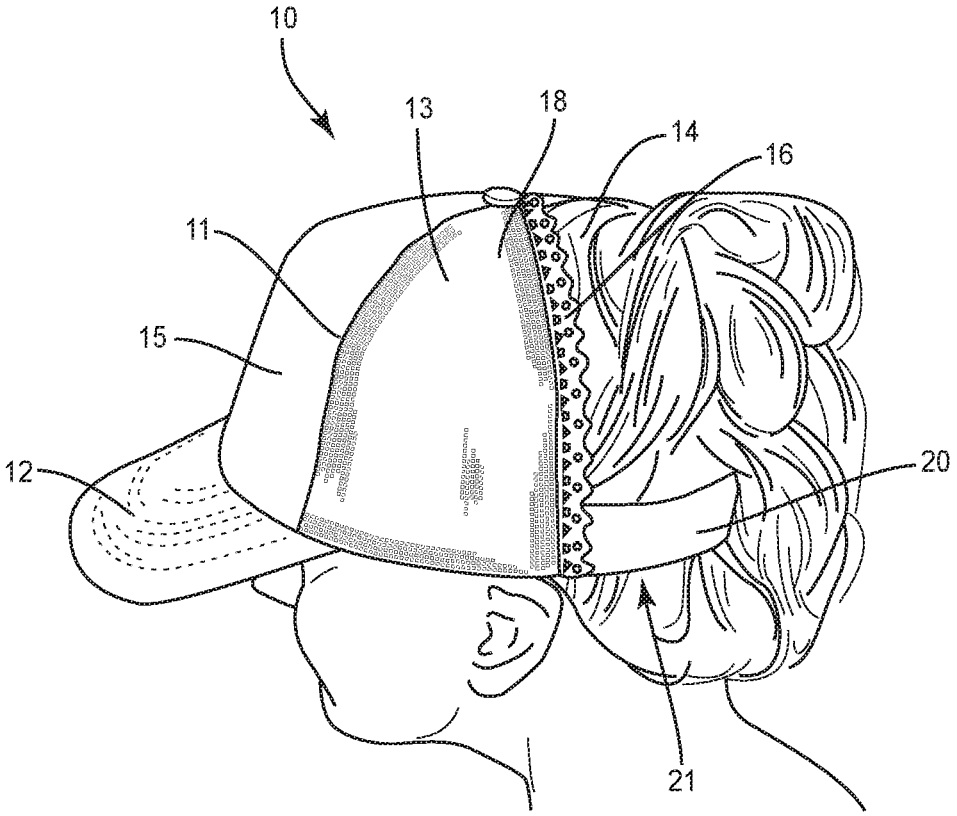
FIG. 1 is a side perspective view of a hat being worn by a user.
Figure 2:
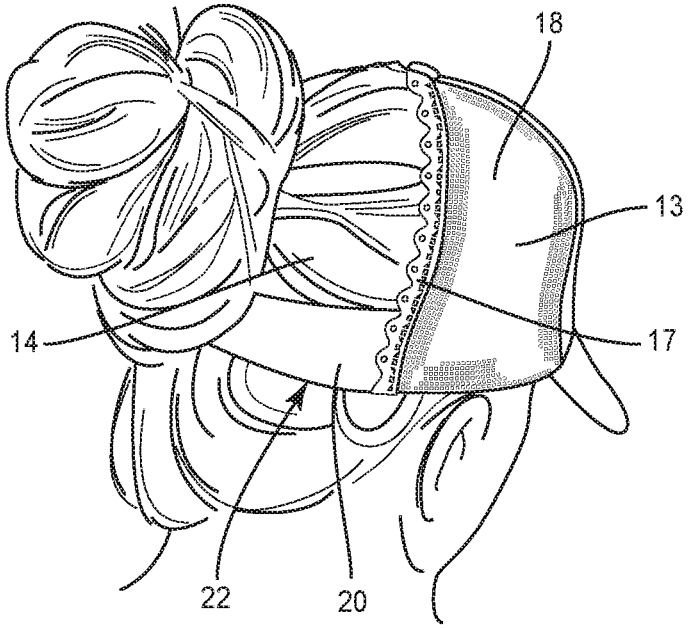
FIG. 2 is a rear perspective view of the hat of FIG. 1 being worn by the user.

As illustrated in FIGS. 1 and 2, the hat 10 includes a closed front section 11 and an open back 14. The hat 10 can also include a bill 12 that extends outward from the front section 11. The front section 11 includes a first lateral side 16 and a second lateral side 17. The size of the front section 11 measured between the first and second lateral sides 16, 17 can vary. The front section 11 can be constructed from a single material. Alternatively as illustrated in FIGS. 1 and 2, the front section 11 can be constructed from two or more different panels 15, 18. A first panel 15 is positioned over the bill 12, a second panel 18 is attached to one side of the first panel 15, and a second panel 18 is attached to a second side of the first panel 15. The panels 18 form respectively the first and second lateral sides 16, 17.

A band 20 extends around a back of the hat 10. The band 20 extends from lower portions of the front section 11. The band 20 includes a first section 21 that extends from the first lateral side 16 as illustrated in FIG. 1 and a second section 22 that extends from the second lateral side 17 as illustrated in FIG. 2. The band 20 also includes extensions 40. One of the extensions 40 is attached to the first section 21 and a second one of the extensions 40 is attached to the second section 22. The extensions 40 are configured to be connected together at different lengths as needed by the user to a size that accommodates the user's head.

An open section 14 is formed in the back of the hat 10 between the lateral sides 16, 17 of the front section 11 and the band 20. The open section 14 provides for a back of the user's head to be exposed. This design may accommodate the user's hair, provides for their head to be exposed which may be cooler for the user during warm weather, and/or also provides an attractive look. The size of the open section 14 may vary. In one embodiment, the open section 14 is about equal to front section 11.

The first and second sections 21, 22 are connected to the front section 11. This can include the first and second sections 21, 22 being integral with the front section 11, or being separately attached by some various means such as but not limited to sewing, mechanical fasteners (e.g., rivets, staples) and adhesives.

The first and second sections 21, 22 can be constructed at least in part from the same material as the front section 11. This can include a sweat band 31 and material 32. In one design, the sweat band 31 extends around the bottom of the front section 11 and along each of the first and second sections 21, 22. The extensions 40 are attached to the first and second sections 21, 22 and can be constructed from different materials, such as plastic.

Figure 3:
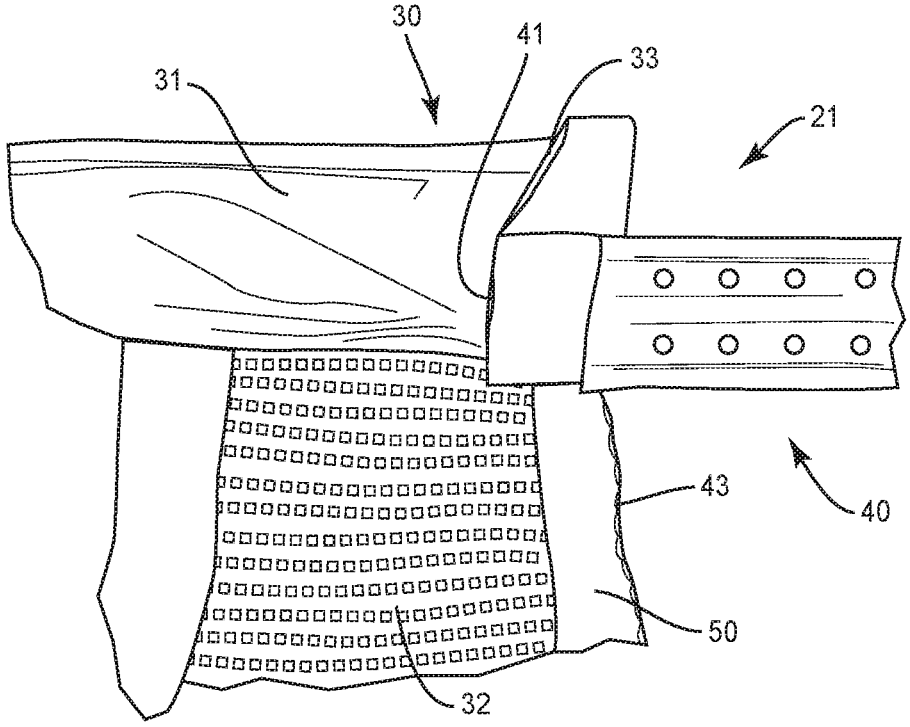
FIGS. 3-9 are side views of steps of making a hat.

FIG. 3-9 illustrate the first section 21 and first extension 40 during assembly. As illustrated in FIG. 3, the first section 21 includes a sweat band 31 and material 32. The sweat band 31 is constructed to contact against the user's head when the hat 10 is being worn. The sweat band 31 may be constructed from a soft material, such as cotton. An end 33 of the sweat band 31 is folded back over an inner portion and stitched together.

The material 32 is attached to and extends upward from the sweat band 31. In one embodiment, the material 32 is stitched onto the sweat band 31. The material 32 may be the same material as the panel 18 of the front section 11. In one embodiment, the material 32 is a nylon mesh. A patch 50 may be attached to the outer end 43 of the material 32. The patch 50 may also extend over the folded section of the sweat band 31. The patch 50 is stitched to the material 32 and sweat band 31 and secured in place. In other exemplary designs, there is no patch 50.

The extension 40 may include openings that correspond with tabs on an extension 40 on the other section of the hat 10. The tabs are sized to engage with the openings to connect the extensions 40 and form the band 20 that extends around the user's head.

Figure 4:
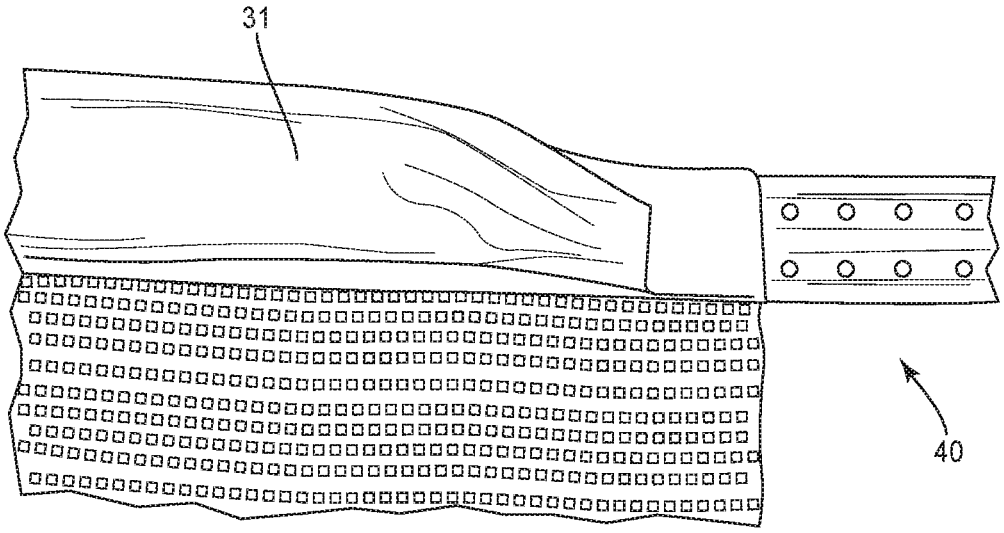
Figure 5:
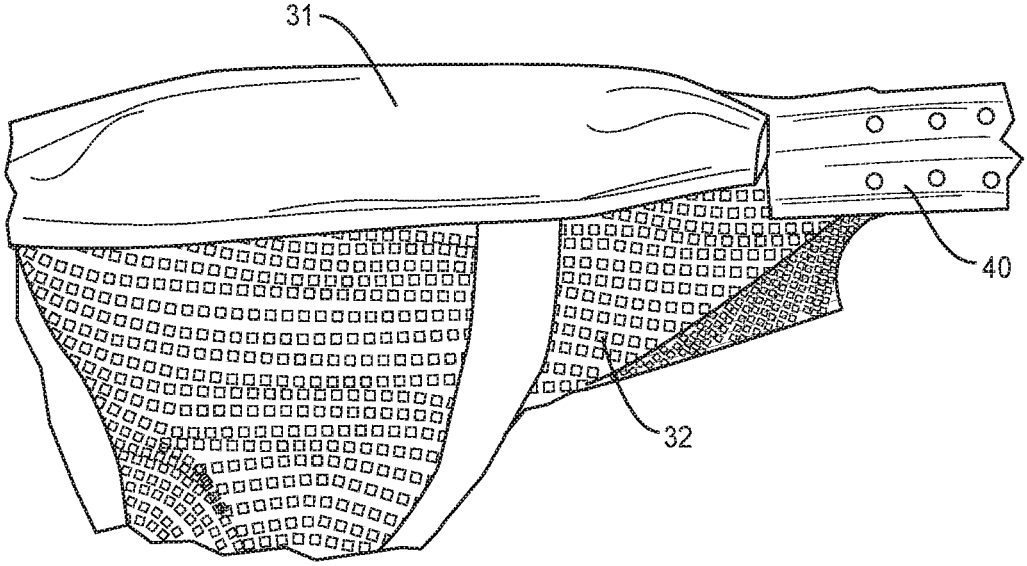

As illustrated in FIG. 3, the inner end of the extension 40 is positioned to overlap with the sweat band 31. As illustrated in FIG. 4, the end of the sweat band 31 is then folded over the extension 40. This fold results in the sweat band 31 having a narrowing width towards the extension 40. Once folded, the sweat band 31 is stitched to maintain the fold and to attach the sweat band 31 to the extension 40. As illustrated in FIG. 5, the top side of the material 32 is also folded. This results in the material 32 having a narrowing width towards the extension 40. Once folded, the material 32 is stitched to maintain the fold.

Figure 6:
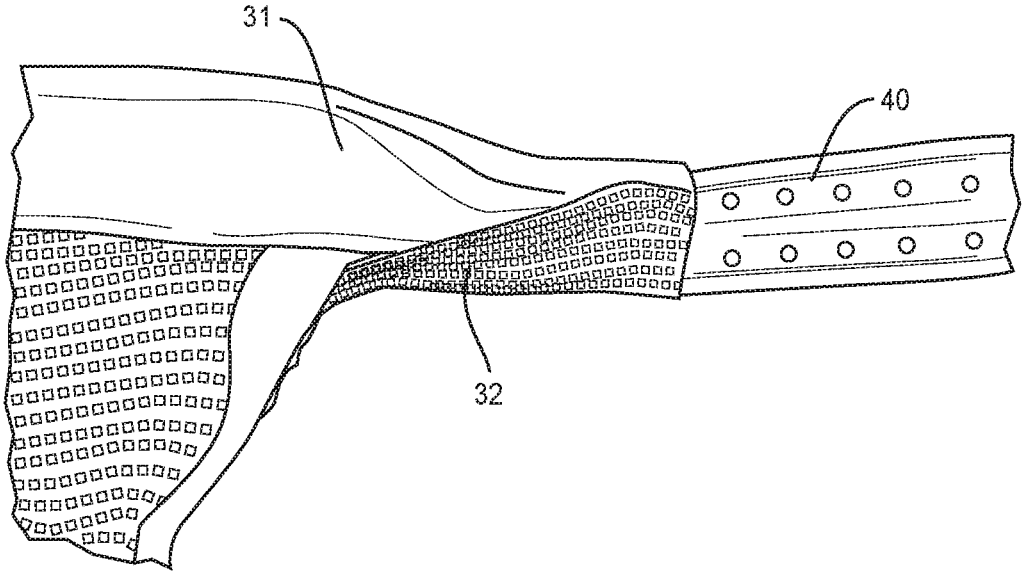
Figure 7:
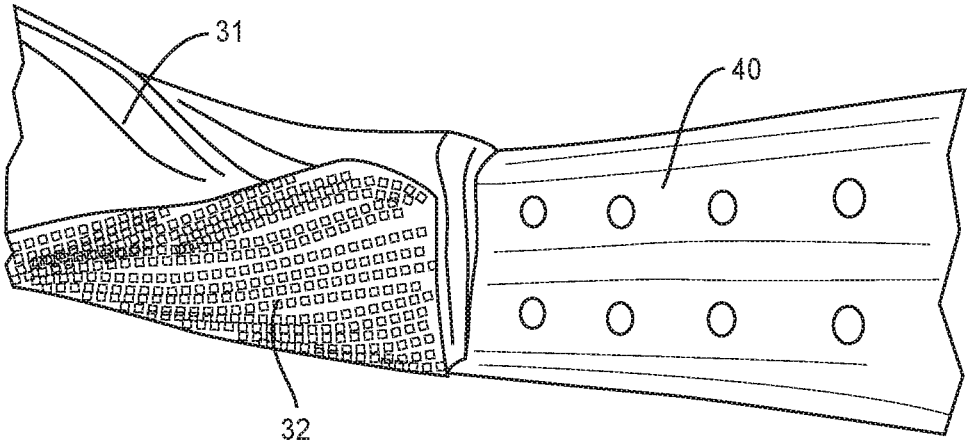

As illustrated in FIGS. 6 and 7, the material 32 is then folded over to meet the sweat band 31. This provides for the sweat band 31 and material 32 to have about the same width as the extension 40. The various layers are sewn together to maintain their position. In one design as best illustrated in FIG. 7, the folded material 32 is positioned over the folded sweat band 31.

Figure 8:
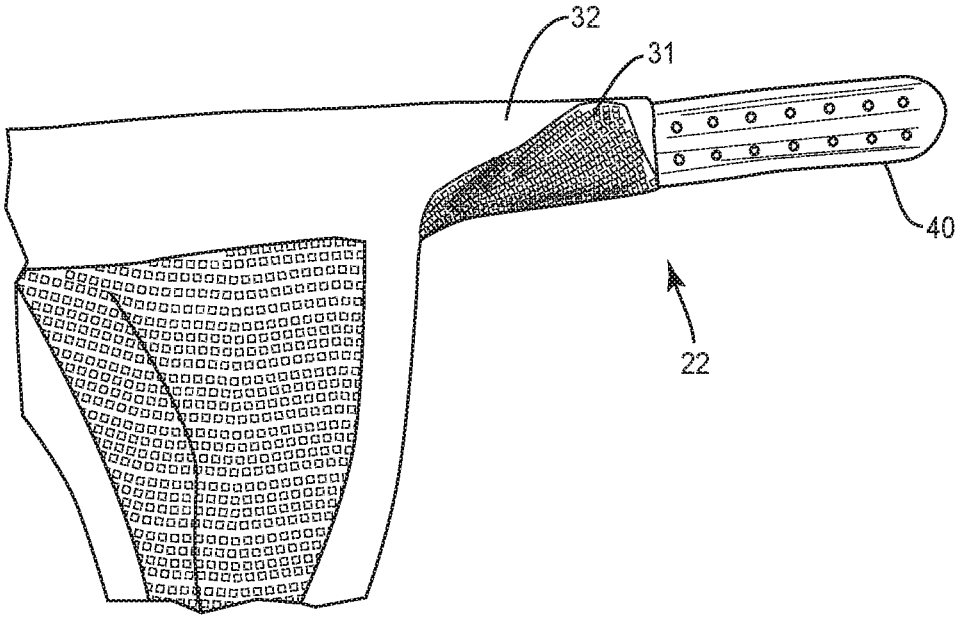

As illustrated in FIG. 8, the opposing second section 22 is constructed in a similar manner. The extension 40 that includes tabs is positioned over the sweat band 31. The sweat band 31 is then folded over the extension 40 and sewn in place, followed by the material 32 being folded over and sewn. Then, the material 32 is folded over to meet the sweat band 31 creating the final positioning as illustrated in FIG. 8. The various sections are stitched together to maintain their position.

The widths of the various sections may vary. In one embodiment, the width of the sweat band 31 in proximity to the front section 11 and prior to folding is about three centimeters. The width tapers downward to the extension 40 that has a width of about two centimeters.

Figure 9:
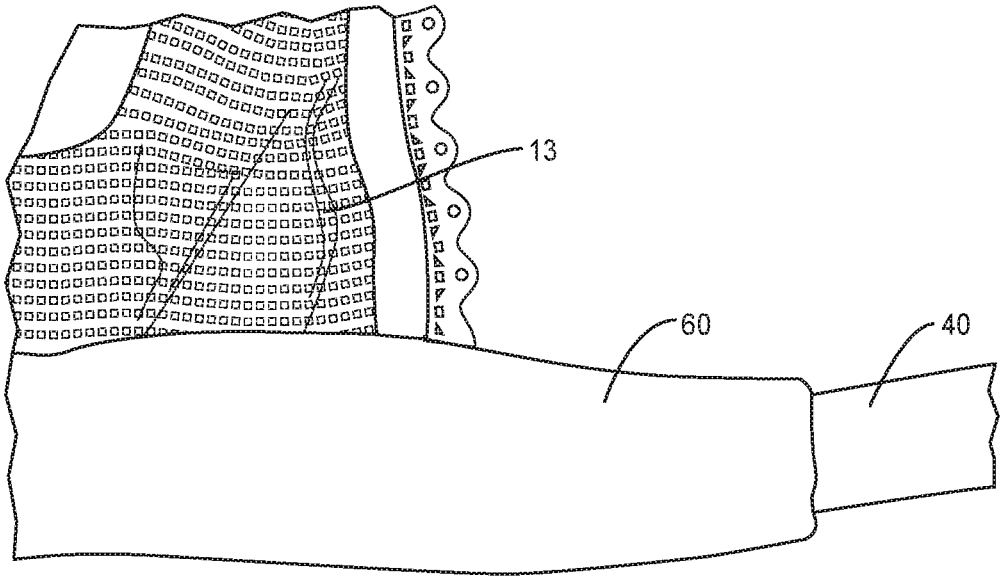

As illustrated in FIG. 9, additional layers 60 may be attached to one or more of the first and second sections 21, 22 and extensions 40. The layers 60 may be constructed from one or more materials that are comfortable to the user. In one embodiment, the layer 60 is terrycloth that includes loops that can absorb perspiration and has a comfortable feel for the user. The one or more layers are sewn onto the inner side of the sweat band 31.

The various components of the first and second sections 21, 22 and extensions 40 may be attached together in a variety of different manners. This may include but is not limited to one or more of stitching, adhesives, and mechanical fasteners such as pins, rivets.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of making an open-back hat that includes a front section with first and second lateral sides, the method comprising:

overlapping a first end of a first extension with a first band at the first lateral side and positioning a second end of the first extension outward and away from the first lateral side;

folding a bottom of the first band over the first end of the first extension;

folding a top of the first band over the first end of the first extension;

attaching together the folded bottom, the folded top, and the first end of the first extension thereby forming a folded band that comprises a width measured between outer edges of the folded bottom and the folded top, the width of the folded band narrows toward the second end of the first extension;

overlapping a first end of a second extension with a second band at the second lateral side and positioning a second end of the second extension outward and away from the second lateral side;

folding a bottom of the second band over the first end of the second extension;

folding a top of the second band over the first end of the second extension; and attaching together the folded bottom, the folded top, and the first end of the second extension.

2. The method of claim 1, further comprising overlapping the first end of the first extension on a sweat band at the first band and overlapping the first end of the second extension on the sweat band at the second band.

3. The method of claim 2, wherein folding the bottom of the first band over the first end of the first extension comprises folding an end of the first band over the first end of the first extension.

4. The method of claim 3, wherein folding the bottom of the second band over the first end of the second extension comprises folding an end of the second band over the first end of the second extension.

5. The method of claim 1, wherein the bottom of the first and second bands is constructed from cotton and the top of the first and second bands is constructed from mesh.

6. The method of claim 1, further comprising forming an opening at a back of the hat between the first and second extensions and the first and second lateral sides.

7. The method of claim 6, wherein the opening extends between the first and second extensions, the first and second lateral sides, and the front section.

8. The method of claim 6, wherein a size of the opening is equal to the front section.

9. The method of claim 1, further comprising positioning openings that extend through the first extension outward beyond the first band and positioning protrusions on the second extension outward beyond the second band.

* * * * *